US006619517B2

(12) United States Patent
Vakiener et al.

(10) Patent No.: US 6,619,517 B2
(45) Date of Patent: Sep. 16, 2003

(54) DISPENSING CLOSURE ASSEMBLY

(75) Inventors: Brian R. Vakiener, Rocky Hill, CT (US); Robert E. Montenieri, Southington, CT (US)

(73) Assignee: Henkel Loctite Corporation, Rocky Hill, CT (US)

( * ) Notice: Subject to any disclaimer, the term of this patent is extended or adjusted under 35 U.S.C. 154(b) by 0 days.

(21) Appl. No.: 10/219,352

(22) Filed: Aug. 16, 2002

(65) Prior Publication Data

US 2002/0190087 A1 Dec. 19, 2002

Related U.S. Application Data

(63) Continuation of application No. 09/809,333, filed on Mar. 15, 2001, now abandoned, which is a continuation-in-part of application No. PCT/US99/20953, filed on Sep. 15, 1999.

(60) Provisional application No. 60/100,318, filed on Sep. 15, 1998.

(51) Int. Cl.[7] ..... B67D 3/00

(52) U.S. Cl. ..... 222/525; 222/541.6; 222/571

(58) Field of Search ..... 222/525, 541.6, 222/571, 108

(56) References Cited

U.S. PATENT DOCUMENTS

| | | | |
|---|---|---|---|
| 3,120,910 | A | 2/1964 | Nyden |
| 4,408,700 | A | 10/1983 | Fillmore et al. |
| 4,754,899 | A | 7/1988 | Stull |
| 4,927,065 | A | 5/1990 | Beck |
| 4,967,941 | A | 11/1990 | Beck |
| 5,052,595 | A | 10/1991 | Mon |
| 5,271,524 | A | 12/1993 | Marston |
| 5,501,377 | A | 3/1996 | Dubach |

FOREIGN PATENT DOCUMENTS

| | | |
|---|---|---|
| BE | 764 535 | 8/1971 |
| GB | 2 102 398 | 2/1983 |
| JP | 10 175659 | 6/1998 |
| WO | WO 96/22919 | 8/1996 |
| WO | WO 00/15540 | 3/2000 |

*Primary Examiner*—Philippe Derakshani
(74) *Attorney, Agent, or Firm*—Steven C. Bauman

(57) ABSTRACT

A dispensing closure assembly provides for the dispensing of fluid from a fluid container. The dispensing closure assembly includes a cap and a dispensing cover which is movably supported with respect to the cap. The dispensing cover includes a distal tip through which the fluid is dispensed. The cover further includes an outer surface extending from the distal tip and continuous therewith defining a fluid drainage surface where residual fluid drains. A finger contacting surface is provided on the cover and space from the fluid draining surface. A fluid containment well is defined between the fluid drainage surface and the finger contacting surface for retaining fluid drained therealong preventing fluid contact along the finger contacting surface.

15 Claims, 8 Drawing Sheets

DISPENSING CLOSURE ASSEMBLY

CROSS REFERENCE TO RELATED APPLICATION

This application is a continuation of application of Ser. No. 09/809,333, filed on Mar. 15, 2001, now abandoned which is a continuation-in-part of International Application No. PCT/US99/20953, filed on Sep. 15, 1999, which claims benefit of Ser. No. 60/100,318, filed on Sep. 18, 1998.

BACKGROUND OF THE INVENTION

1. Field of the Invention

The present invention relates to a dispensing closure assembly for liquids of various viscosity. More specifically, the present invention is directed to a single dispensing closure assembly for precisely dispensing anaerobic adhesives and sealants of various viscosities.

2. Description of the Related Art

Various designs for fluid dispensing closure assemblies are known which dispense the contents of a container over which the dispensing closure assembly is placed. Additionally, these closure assemblies provide for sealing the container between usages. These dispensing closure assemblies generally include a stationary cap which is attachable to the container of fluid and a cover which is movable with respect to the cap so as to open a dispensement passageway through the assembly and thereby place the contents of the container in fluid communication with a dispense opening in the cover so that the fluid may be dispensed. Such dispensing closure assemblies may be either twisted open and closed or pushed-pulled open and closed so as to effect the relative movement of the cap and cover. Many known dispensing closure assemblies also permit relative movement of the cap and the cover so as to vary the dispense opening so as to increase or decrease the flow rate of the dispensed fluid.

In addition to accounting for viscosity considerations, the nature of the fluid to be dispensed should also be considered. For example, since certain adhesives, such as cyanoacrylates, cure in presence of moisture, while others, such as anaerobics, cure in the absence of oxygen, the dispenser should be designed with the ability to accommodate the particular requirements of the adhesive to be dispensed while also providing a convenient method of selecting an appropriate and versatile means for doing so.

Anaerobic adhesives are characterized by curing in the absence of oxygen through contact with active metals, such as iron and copper. Many of the existing dispensing closure assemblies for anaerobic adhesives allow active metal contaminants thereinto through the dispense opening during the course of dispensing the adhesive. These contaminants have the deleterious effect of accelerating the curing mechanism in adhesive still contained within the dispense passageway which results in eventual blockage of the dispensing closure assembly. Once this occurs, an operator usually cuts such dispense assemblies proximal to the cured blockage in order to again allow for dispensing of the adhesive from the container. Cutting a dispensing closure assembly, however, may result in a differently-sized dispense orifice and thereby significantly change the dispense characteristics for the assembly. The drawback of contaminants into the dispensing closure assembly can be minimized by tailoring the size of the dispense orifice to the viscosity of the fluid being dispensed so as to provide for precise metering of the fluid therethrough. These problems are multiplied when the dispenser is involved in assembly-line operations such as in the automotive or electronics industries.

Adhesives as a general class of fluids useful in the present invention, however, exhibit a wide variety of viscosities, ranging from a fluid being less viscous than water to a flowable paste. The actual rheology of the adhesive used will depend on the intended application. Dispense assemblies having only a single-size dispense orifice may precisely dispense a bead of adhesive when the viscosity of the adhesive is suited to the geometry of the dispense orifice provided. If the same dispensing closure assembly is used for a different adhesive, however, the geometry of the dispense orifice may neither adequately contain adhesives having a lower viscosity nor adequately dispense adhesives having a higher viscosity. Additionally, it is generally desirable to provide a dispensing closure assembly which may accommodate a range of fluid viscosities so as to reduce the manufacturing costs of producing unique dispensing closure assemblies for fluids of narrow ranges of viscosities.

Towards this end, known dispensers have often attempted to accommodate a wide range of viscosities by providing dispensing closure assemblies having a range of selectably-sized dispense openings at the dispense tip. One such example is shown in U.S. Pat. No. 5,501,377, where a dispensing closure assembly includes a central cylindrical sealing post which is variably positionable within a conical or tapering cover wall so as to provide a full range of dispense opening areas at the dispense orifice. For a fluid of a given viscosity, precise dispensement thereof through a series of assembly closures and openings is suspect due to the fully variable cross-sectional area which may be provided at the dispense orifice. That is, the user is unlikely to precisely select an appropriate dispense opening area each time the dispensing closure assembly is opened.

Another example is shown in U.S. Pat. No. 4,927,065, which provides a dispense orifice of discretely changing dispense orifice sizes by positioning a central sealing post having a series of steps formed at its distal end within a cover having a cylindrical dispense aperture. From a closed position where the post extends through the dispense orifice, the post is withdrawn through the cover so as to place different-size steps within the dispense orifice to vary the geometric configuration at the dispense orifice. While providing a more repeatable variation in the dispense orifice, such a design may not be suitable for dispensing anaerobic fluids due to the contamination risk from the post extending out from the cover in the open position. The post is likely to contact the surface to which the adhesive is being applied and to collect particles of that surface which may, in turn, cure the adhesive on the post. For example, particles of brass or other active metals that collect on the post can cause the adhesive thereon to cure very quickly. Adhesive curing on the steps of the post will change the diameter of the post at that location, and thereby affect the dispensing characteristics of the dispensing closure assembly. Furthermore, as the post is exposed during application of the adhesive, the post is more susceptible to being bent or damaged. This too prevents precise dispensement of a fluid. And, from a manufacturing standpoint, it is often times difficult to mold a thin post having a complex geometry at its distal end due to the manner by which such molds accept the moldable plastic and by which the post is withdrawn from the mold in a direction towards its proximal end.

In addition, such designs may not be suitable in many applications because in the course of accommodating a wide range of viscosities, the user is left with more options than may be desirable for day-to-day applications in which precise metering of an adhesive is of paramount importance. For example, when a dispensing closure assembly allows a user to select between three dispense opening sizes depending upon the type of fluid to be dispensed, each time the user opens the dispensing closure assembly there is a risk that the user may incorrectly select an incompatibly-sized dispense opening. Should the user select too large a dispense opening for a low viscosity fluid, far too much fluid may be dispensed onto a high cost component which must then be either cleaned or discarded. The likelihood of the user selecting an incompatibly-sized dispense opening is higher still in manufacturing environments where the operator opens and closes the dispensing closure assembly many times during the course of use.

Furthermore, in many dispensing closure assemblies of the prior art, it is common for residual adhesive to cling to the dispense tip after use. Once the container, including the dispensing closure is uprighted, the residue adhesive will drip down the outer surface of the dispensing closure cover. Since many dispensing closure covers are manually actuated to move from an open to a closed position, it is quite common for the user to manually grasp the outer surface of the cover to effect such manual operation. Thus, the user would come in contact with any adhesive residue which drips down the side of the dispensing closure cover. Such adhesive residue and the risk of coming into contact therewith during operation, renders subsequent use of the dispensing closure assembly undesirable.

It is, therefore, desirable to provide a dispensing closing assembly which prevents residual adhesive from dripping to location which is to be contacted by the user during operation. This will enable the user to repeatedly use to the dispensing closure assembly with out risk of contacting the residual adhesive.

SUMMARY OF THE INVENTION

The present invention provides a dispensing closure assembly for dispensing fluid from a fluid container. The closure assembly includes a cap attachable to the open end of the container. The cap has a sealable dispensing port with a port opening for passage of fluid therethrough. A dispensing cover is movably supported over the cap. The dispensing cover is an elongate member having a dispensing tip at one end, a port engaging portion at the other end and a dispensing channel therebetween. The dispensing cover is movable between a closed position with the port engaging portion in engagement with the port for sealing the dispensing port. The dispensing cover is moveable to an open position permitting fluid communication between the dispensing port and the channel and the dispensing of fluid through the distal tip. The cover further includes an outer surface extending from and contiguous with the dispensing tip. This outer surface defines a fluid drainage surface where residual fluid from the dispensing tip flows. A finger contact surface is provided on the outer surface of the cover which is spaced from the dispensing tip. A fluid containment well is formed between the fluid drainage surface and the finger contacting surface for retaining fluid drained along the draining surface, preventing fluid contact with the finger contacting surface.

The dispensing tip desirably includes a first dispensing opening defined at the distal end thereof. This dispensing tip is configured to accommodate a standard luer cannula slip over the distal end for dispensement of fluid therethrough. The dispensing tip also desirably includes a score notch adjacent the distal end for severing the distal end therefrom. This defines a second larger dispensing opening.

The dispensing closure assembly of the present invention further desirably includes an overcap positionable over the cap and dispensing cover for closing the dispensing tip. The overcap defines an open-ended cavity including a cavity wall which is placed in sealed engagement with the dispensing tip by sealing and closing the dispensing tip.

DETAILED DESCRIPTION OF THE INVENTION

Figure 1:
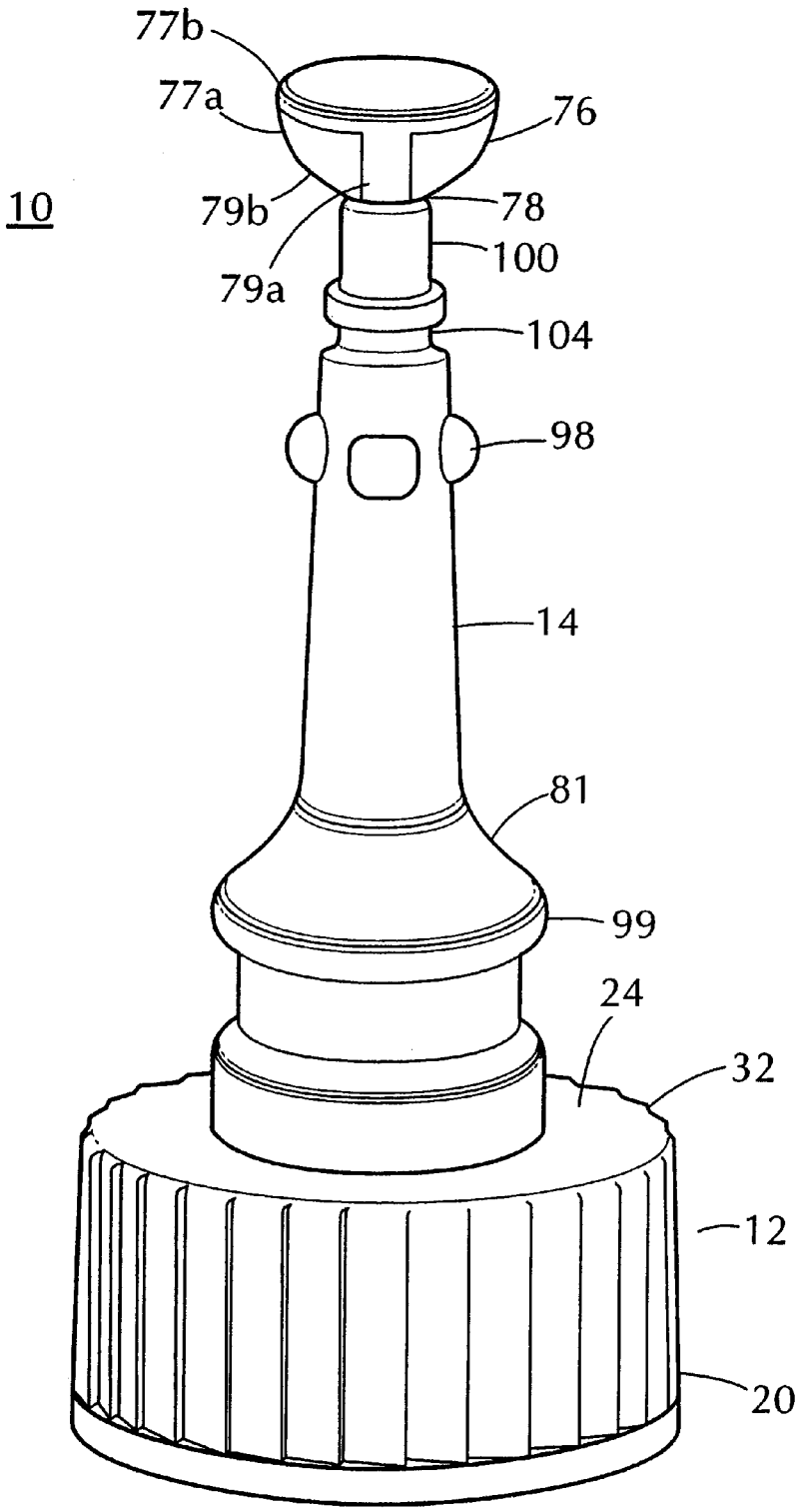
FIG. 1 shows a perspective view of the dispensing closure assembly of the present invention.

Referring to FIG. 1, the present invention provides a dispense closure assembly 10 for dispensing a fluid such as an anaerobic adhesive. Dispense closure assembly 10 includes a cap 12 and a cover 14. Each of cap 12 and cover 14 may be formed of a suitable plastic by conventional manufacturing techniques. For example, cap 12 is desirably formed from high density polyethylene and cover 14 is desirably formed of a softer plastic such as polypropylene and the like. The material selected for both cap 12 and cover 14 should be breathable in that air may pass therethrough and inhibit premature curing of the fluid within assembly 10. Cover 14 is longitudinally movable with respect to cap 12 from a closed position blocking fluid flow through cover 14 to an open position allowing precise fluid metering through cover 14. In the present illustrative embodiment, dispensing closure 10 employs a push-pull arrangement to effect the relative longitudinal movement of cover 14 with respect to cap 12 between the open and closed positions, as will be described further hereinbelow.

Assembly 10 may dispense fluids having a viscosity anywhere in the range of 10 centipoise (cps) to 8,000 cps requiring no more than lightly compressing a flexible portion of the container (not shown) to which it is attached. Assembly 10 provides for the user to select from up to three possible sizes for a dispense opening through which the fluid is dispensed through cover 14 to a work surface. The selection of the proper dispense opening size is determined according to the viscosity of the fluid to be dispensed. The user need only make the selection prior to dispensing the contents of the container for the first time. The user may thereby dedicate dispensing closure assembly 10 to provide a dispense opening particularly suited to the fluid viscosity of the contents of the container. Once so dedicated, the user need only open and close dispensing closure assembly 10 prior to and after each use. The selection of the proper dispense opening size will be described in further detail hereinbelow.

Figure 2A:
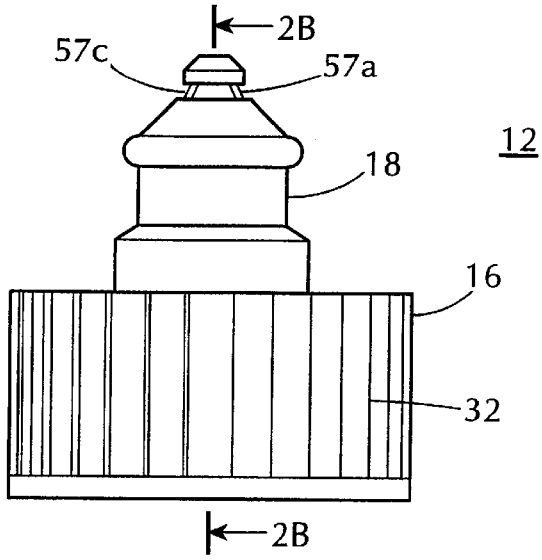
FIG. 2A is a side elevational view of the cap of the dispensing closure assembly of FIG. 1.
Figure 2B:
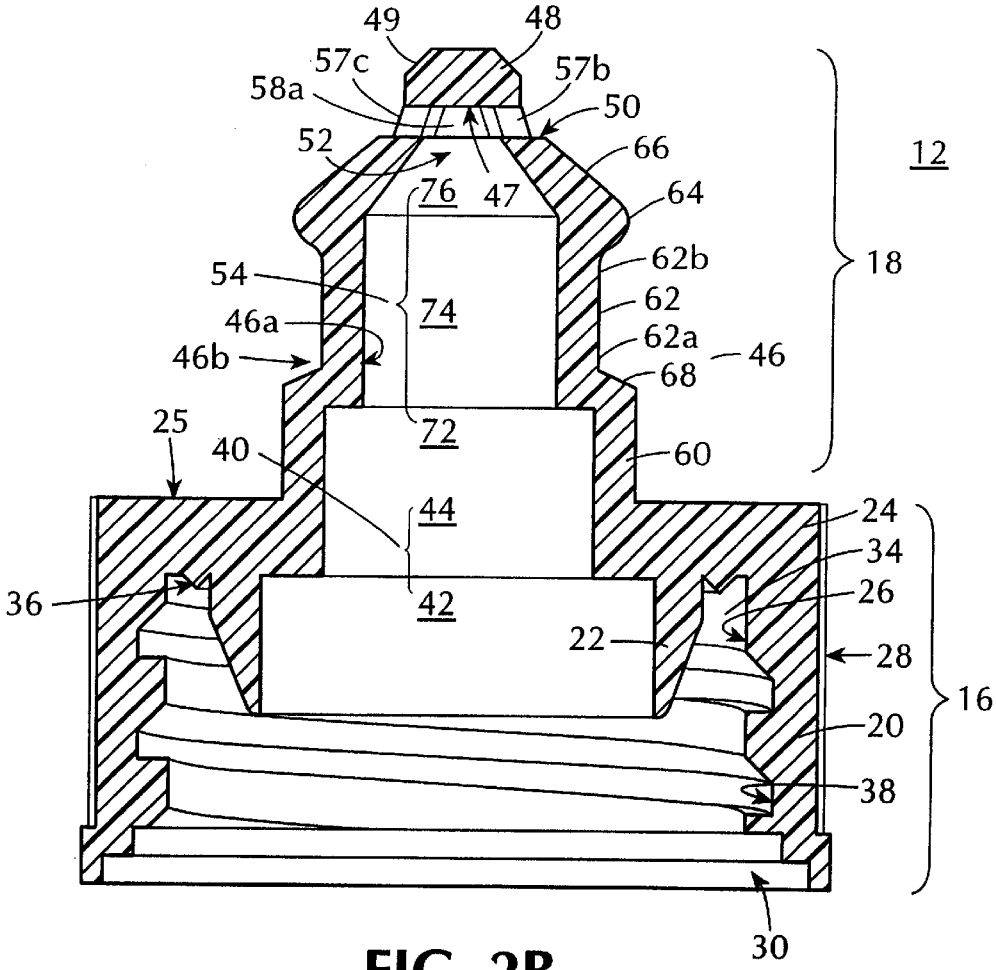
FIG. 2B is a cross-sectional view of the cap of the dispensing closure assembly of FIG. 1.

Referring now to FIGS. 2A and 2B, cap 12 includes a base portion 16 and an elongate dispense valve portion 18. Base portion 16 includes an elongate cylindrical outer wall 20 and an elongate cylindrical inner wall 22 coaxial with and radially inward with respect to outer wall 20. A generally planar transverse support wall 24 spans across a distal extent of first cylindrical wall 20 and second cylindrical wall 22 and supports dispense valve portion 18. Outer wall 20 includes an interior surface 26, an exterior surface 28 and defines a cap opening 30 opposite transverse support wall 24. Exterior surface 28 has formed thereon a plurality of circumferentially-spaced longitudinal gripping ribs 32 so as to assist manual gripping of cap 12 during both threading attachment with the adhesive container and longitudinally moving cover 14 with respect thereto. Base portion 16 of cap 12 further defines a proximal cap passageway 40 having a first portion 42 defined by inner wall 22 and a second portion 44 defined by transverse support wall 24 in coaxial alignment with first portion 42. Proximal cap passageway 40 is in fluid communication with the interior of the container of adhesive fluid and forms the first stage of the fluid flowpath for dispensing fluid within the container through dispensing closure assembly 10.

Interior surface 26 and inner wall 22 define an annular container receiving cavity 34 therebetween for fluid-tight engagement with a male connecting portion of the container of flowable anaerobic adhesive. Transverse support wall 24 desirably includes a depending annular sealing tooth 36 for enhanced sealing engagement with the annular rim of the male connecting portion of the container. Interior surface 26 has formed thereon a helical thread 38 so as to provide a threaded connection with the container.

Dispense valve portion 18 extends from transverse support wall 24 in registry with proximal cap passageway 40. Dispense valve portion 18 includes a tubular conduit wall 46 and a coaxially-located cylindrical hub 48. Conduit wall 46 terminates at a planar valve seat 50 which defines a cap dispense aperture 52. Conduit wall 46 includes an interior conduit surface 46*a* and an exterior conduit surface 46*b*. Interior conduit surface 46*a* further defines a distal cap passageway 54 communicating between proximal cap passageway 40 and cap dispense aperture 52. Hub 48 is positioned in spaced registry with cap dispense aperture 52 and includes a planar lower hub surface 47 in registry with dispense aperture and an upstanding cylindrical hub surface 49 coaxial therewith. Hub 48 is connected to conduit wall 46 by three leg extents 57*a–c* extending from hub surface 47 to a location on interior conduit surface 46*a* adjacent planar valve seat 50. Leg extents 57*a–c* are spaced so as to define three sealable openings 58*a–c* in fluid communication with cap dispense aperture 52.

Exterior conduit surface 46*b* includes a first elongate cylindrical surface 60, a second recessed elongate cylindrical surface 62, an annular stop bead 64, and a tapered annular skirt 66. First cylindrical surface 60 is contiguous with second cylindrical surface 62 across an annular tapered rim 68. Second cylindrical surface 66 is therefore bounded at a proximal end 66*a* by tapered rim 68 and at a distal end 66*b* by stop bead 64. Tapered rim 68 and stop bead 64 provide for the relative longitudinal positioning of cap 12 and cover 14 in the closed and open positions as will be described hereinbelow. For manufacturing purposes, interior conduit surface 46*a* generally follows the contour of exterior conduit surface 46*b* at cylindrical surfaces 60 and 62.

Figure 3:
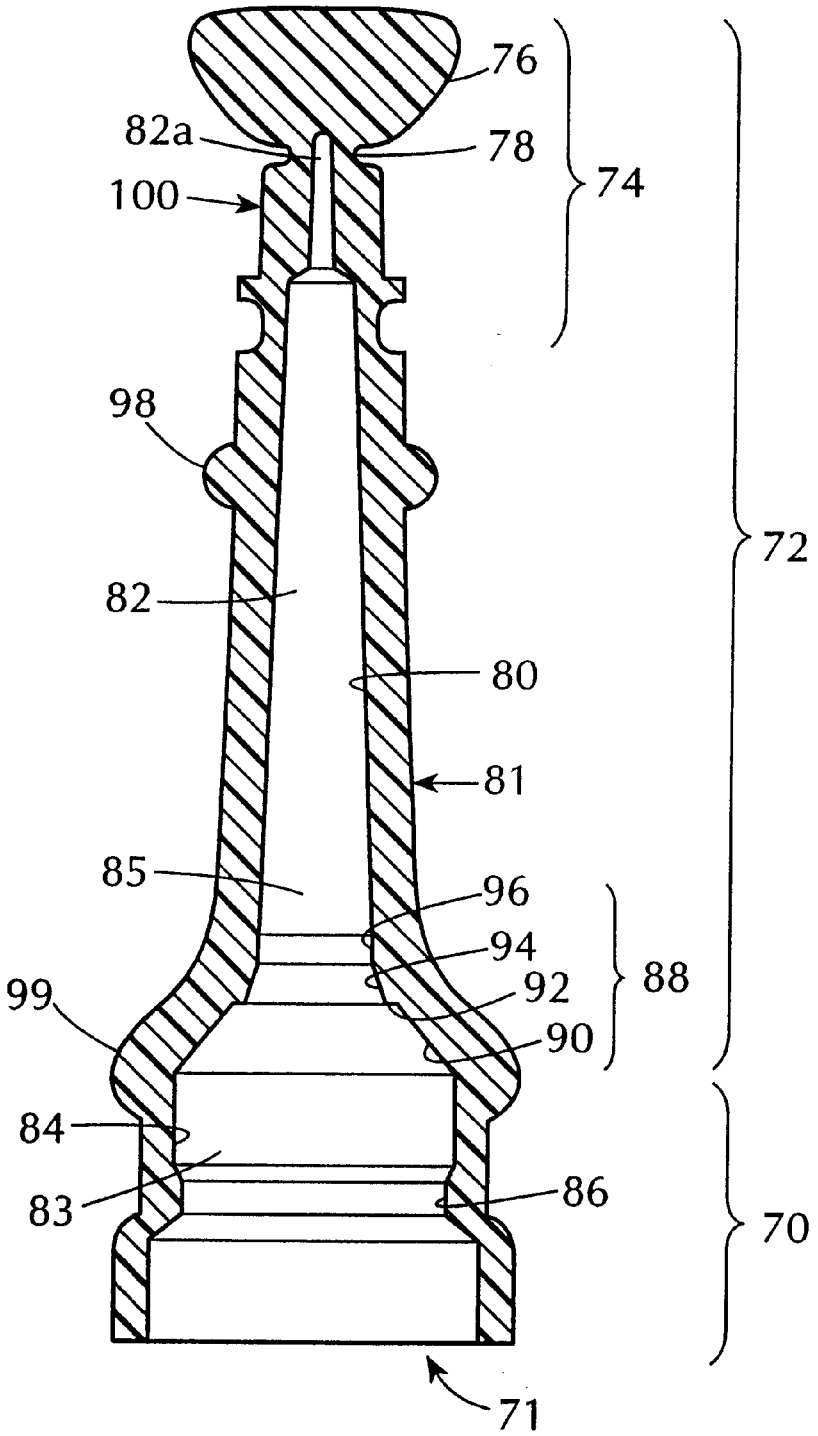
FIG. 3 shows a cross-sectional view of the cover of the dispensing closure assembly of FIG. 1.
Figure 4:
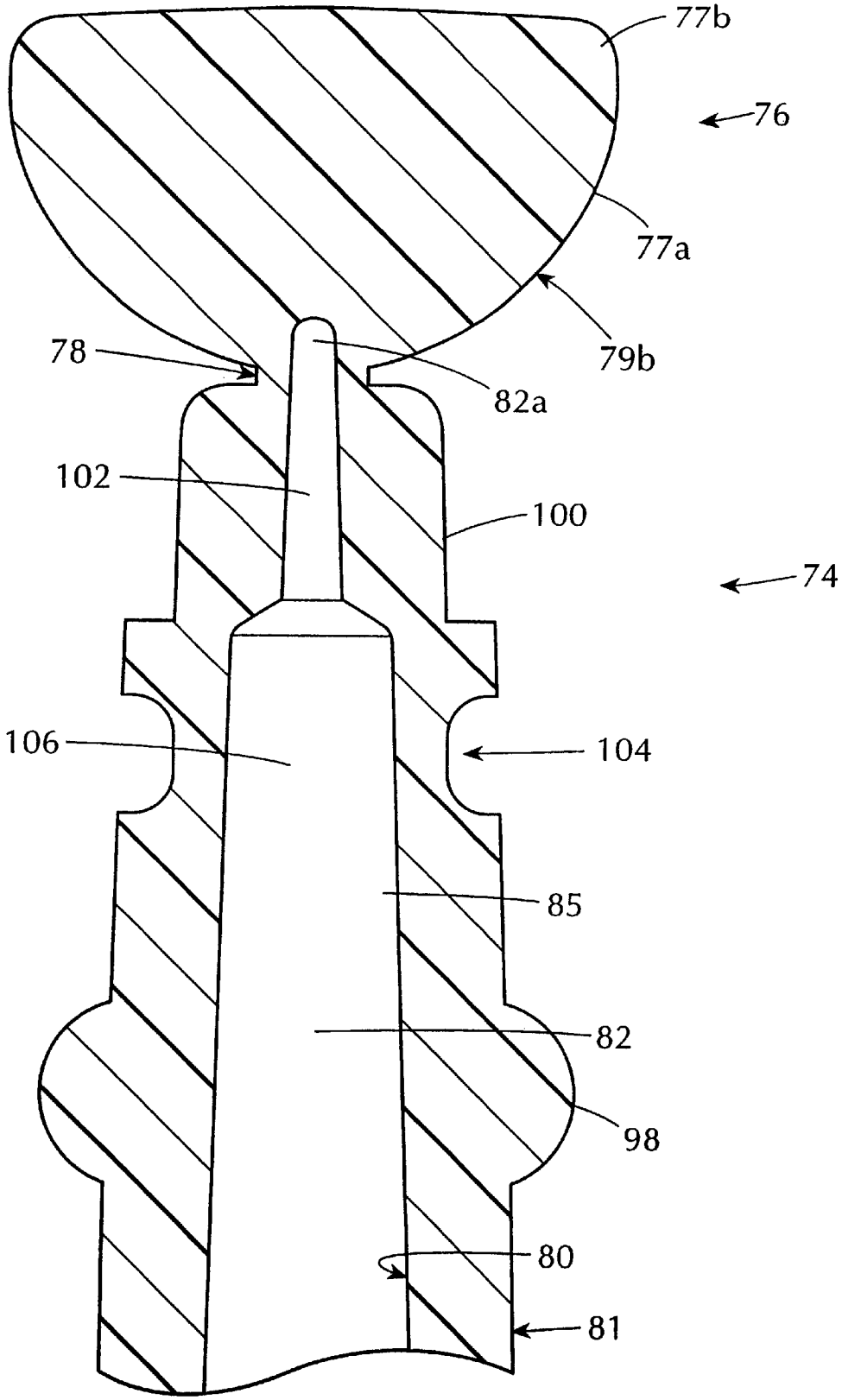
FIG. 4 shows a cross-sectional view of the dispensing tip of the present invention.

Referring now to FIGS. 1, 3, and 4, cover 14 is an elongate hollow member and includes an elongate hollow mechanical working portion 70 and an elongate hollow fluid conduit portion 72. Fluid conduit portion 72 further includes a dispensing end 74 originally provided having a removable tip 76 attached thereto across a frangible neck 78. Cover 14 includes an interior cover surface 80 and an exterior cover surface 81. Interior cover surface 80 defines a cover interior 82 which includes a mechanical working space 83 defined by mechanical working portion 170 and a dispensing passageway 85 defined by fluid conduit portion 72.

Mechanical working portion 70 of cover 14 defines a proximal cover opening 71 for receiving dispensing valve portion 18 of cap 12 therethrough. Mechanical working portion 70 further includes elements for cooperating with stop bead 64 and tapered rim 68 of cap 12 so as to define the closed and open configurations of dispensing closure 10. Interior cover surface 80 includes an elongate cylindrical cover bushing surface 84 supporting an annular cover positioning rib 86 at one end thereof. With additional reference to FIGS. 5 and 6, the relative alignment of cover positioning rib 86 along second cylindrical surface 62 of cap 12 provides the closed and open positions for the dispense closure assembly 10. As cover 14 is moved between and open and closed position, annular stop bead 64 of cap 12 provides wiping sliding engagement with cover bushing surface 84 so as to prevent any fluid from passing therebetween.

Figure 5:
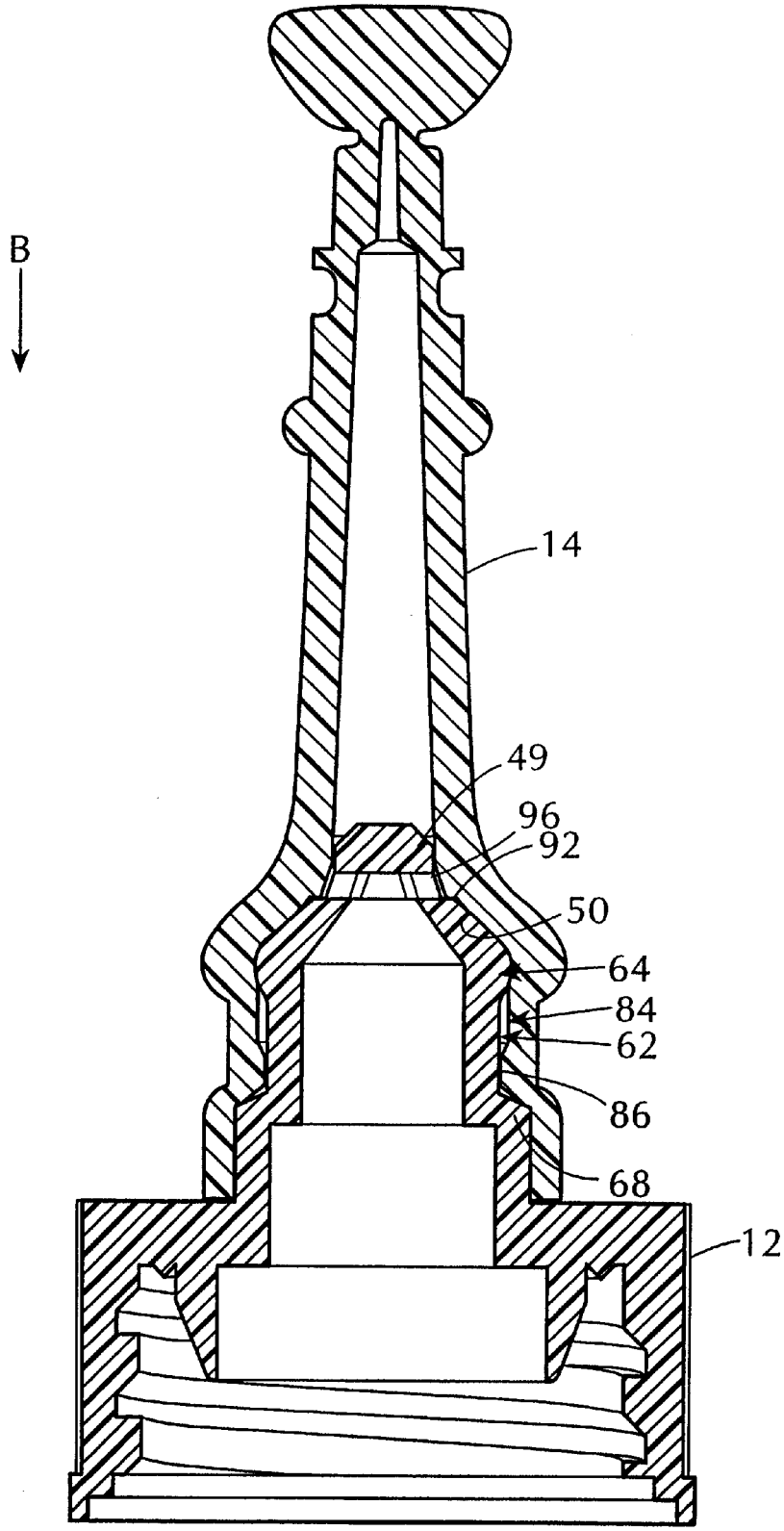
FIG. 5 shows a cross-sectional view of the dispensing closure assembly of FIG. 1 in the closed configuration.
Figure 6:
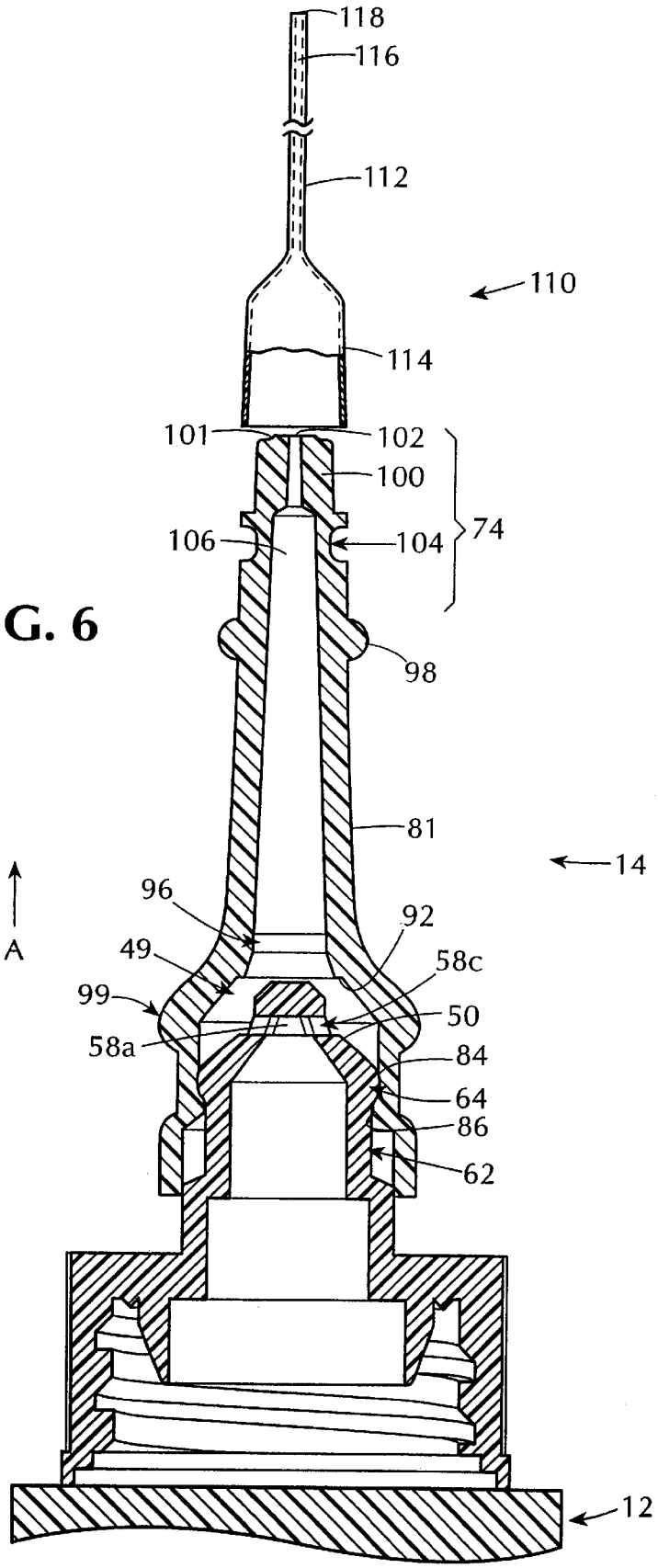
FIG. 6 shows a cross-sectional view of the dispensing closure assembly of FIG. 1 in an open configuration.

Referring now to FIGS. 3, 5, and 6, fluid conduit portion 72 of cover 14 includes a valve section 88 defined by the geometry of interior cover surface 80 about sealable openings 58*a–c* of cap 12. Valve section 88 is a contiguous stretch of interior cover surface 80 including an annular tapered surface 90, a planar seating surface 92, a flared passageway extent surface 94, and a cylindrical hub-sealing surface 96. Surfaces 90, 92, 94, and 96 are formed to be coaxial with dispensing passageway 85. As shown in FIG. 5, when dispensing closure assembly 10 is in the closed configuration, cover 14 provides sealing engagement with cap 12 so as to prevent fluid communication between sealable openings 58*a–c* and both ends of cover 14. In the closed configuration a primary seal is established where planar seating surface 92 sealingly engages planar valve seat 50 and a secondary seal is established where hub-sealing surface 96 sealingly engages cylindrical hub surface 49. As further shown in FIG. 5, a third sealing engagement is provided where stop bead 64 of cap 12 sealingly engages cover bushing surface 84 so as to provide a third sealing engagement between cap 12 and cover 14 below sealable openings 58*a–c*. The primary seal prevents fluid flowing from sealable openings 58*a–c* towards dispensing end 74 while the secondary and third seals prevent liquid from flowing towards cover opening 71.

FIG. 6 shows dispensing closure assembly 10 in an open configuration whereby cover 14 is longitudinally moved in the direction of arrow A from cap 12. It is seen that in the open configuration that the primary and secondary seals are temporarily broken while the third seal provided between cover positioning rib 86 of cover 14 and stop bead 64 of cap 12 is maintained. As planar seating surface 92 and cylindrical hub sealing surface 96 no longer engage any part of cap 12, sealable openings 58*a–c* are placed in fluid communication with dispensing passageway 85.

With additional reference to FIG. 4, dispensing end 74 allows a user to select the size of a dispense orifice so as to provide for precise metering of the fluid therethrough. Frangible neck 78 is an annular member formed about a distal end 82*a* of cover interior 82 between a cylindrical tip 100 and removable tip 76. Removable tip 76 is desirably formed having a cross-shaped component 77*a* presenting a pair of intersecting arcuate lower surfaces 79*a* and 79*b* and supporting a disc-shaped upper component 77*b*. The cross-shape of component 77*a* is selected to minimize the amount of material required by removable tip 76 while the disc-shaped component 77*b* allows for hot runner molding of cover 14 at relatively faster cycling times. Removable tip 76 and frangible neck 78 are designed to expose a first dispensing port 102 defined by cylindrical tip 100 when removable tip 76 is either twisted or sheared from cover 14. The material selected for cover 14 should be sufficiently brittle so as to minimize the occurrence of flashing about first dispensing port 102. Flashing being any extraneous material or rough surface disposed about or occluding first dispensing port 102. By minimizing the occurrence of flashing the present invention also minimizes the likelihood of entrapping particles which may provoke curing of the anaerobic adhesive across or within dispensing passageway 85. Dispensing end 74 desirably provides an annular dispensing tip rim 101 about the proximal end of cylindrical tip 100.

Referring again to FIG. 6, first dispensing port 102 is formed having a diameter selected to provide precise metering of fluids of medium viscosities and adequate metering characteristics for fluids having low viscosities. In order to better accommodate low viscosity fluids, cylindrical tip 100 is formed having a diameter which accommodates a luer slip cannula assembly 110 thereover in frictional engagement. Luer slip cannula assembly 110 is well known in the medical arts for dispensing medicaments and includes an elongate cannula 112 and a luer adapter 114 at one end thereof. Cannula 112 defines an elongate cannula passageway 116 and a cannula dispense port 118 having a diameter smaller than that provided by first dispensing port 102. Cannula 112 thereby provides for even more precise metering of low viscosity fluids at cannula dispense port 118 than is provided by first dispensing port 102 at cylindrical tip 100.

The uniform cross-sectional shape of cylindrical tip 100 and the severing of removable tip 76 ensure reproducible and reliable dispensing closure assembly 10 compatibility with luer adapter 114 in that there is no risk of a user over-cutting the dispense tip or of the assembly. After separating removable tip 76 therefrom, a user would simply slide luer adapter 114 over cylindrical tip 100 until abutting annular dispensing tip rim 101. Luer slip cannula assembly 110 is also desirably formed from a breathable plastic material so as to inhibit premature curing of an anaerobic adhesive therein. The present invention further contemplates providing a luer slip cannula assembly 110 in kit form with dispensing closure assembly 110 for dispensing fluids having a low viscosity.

Dispensing closure assembly 10 also accommodates dispensement of fluids having a relatively high viscosity. Exterior cover surface 81 defines an annular mitre channel 104 adjacent cylindrical dispensing tip 100 for guiding a hand-held cutting device in severing cover 14 so as to expose a second dispensing port 106 having a diameter that is greater than the diameter of first dispensing port 102. Mitre channel 106 is formed about a portion of dispensing passageway 85 having a diameter larger than provided through cylindrical tip 100. Second dispensing port 108 is thereby better suited to accommodating and precisely metering fluids having a relatively high viscosity. Desirably, mitre channel 106 extends in substantially transverse coaxial alignment with dispensing passageway 85.

As the container to which dispensing assembly 10 is mounted will indicate the particular fluid contained therein, a user will know prior to dispensing the fluid just how large a dispense orifice is required for precise metering of the fluid. For low and medium viscosity fluids, the user may choose to simply separate removable tip 76 from cover 14 and proceed to dispense. Or, for low viscosity fluids the user may couple a luer slip cannula assembly over cylindrical tip 100 so as to dispense through a smaller dispense orifice. Alternatively, for relatively high viscosity fluids, the user may cut cover 14 at miter channel 106 so as to expose a larger dispense orifice. Once the initial dispense orifice decision is made, the user need only open and close dispensing closure assembly 10 with each use. The present invention is thereby able to accommodate fluids of a range of fluid viscosities while also minimizing the occurrence of the user improperly selecting the size of the dispense orifice and dispensing copious amounts of fluid onto a work surface.

A user may close dispensing closure assembly 10 by applying a longitudinal closing force in the direction of arrow B, shown in FIG. 5, to force positioning rib 86 of cover 14 back towards tapered rim 68 of cap 12 until the primary and secondary seals are re-established. Once again, during the relative longitudinal movement of cover 14 and cap 12, stop bead 64 of cap 12 continues to wipingly slide along cover bushing surface 84 to prevent fluid from passing therebetween into mechanical working space 83. Exterior surface 81 of cover 14 is formed having a generally smooth contour to accommodate a user opening and closing dispensing closure assembly 10 many times in a day. Exterior surface 81 provides a number of rounded projections 98 and an annular exterior gripping bead 99 to further assist a user in opening and closing dispensing closure assembly 10.

Figure 7:
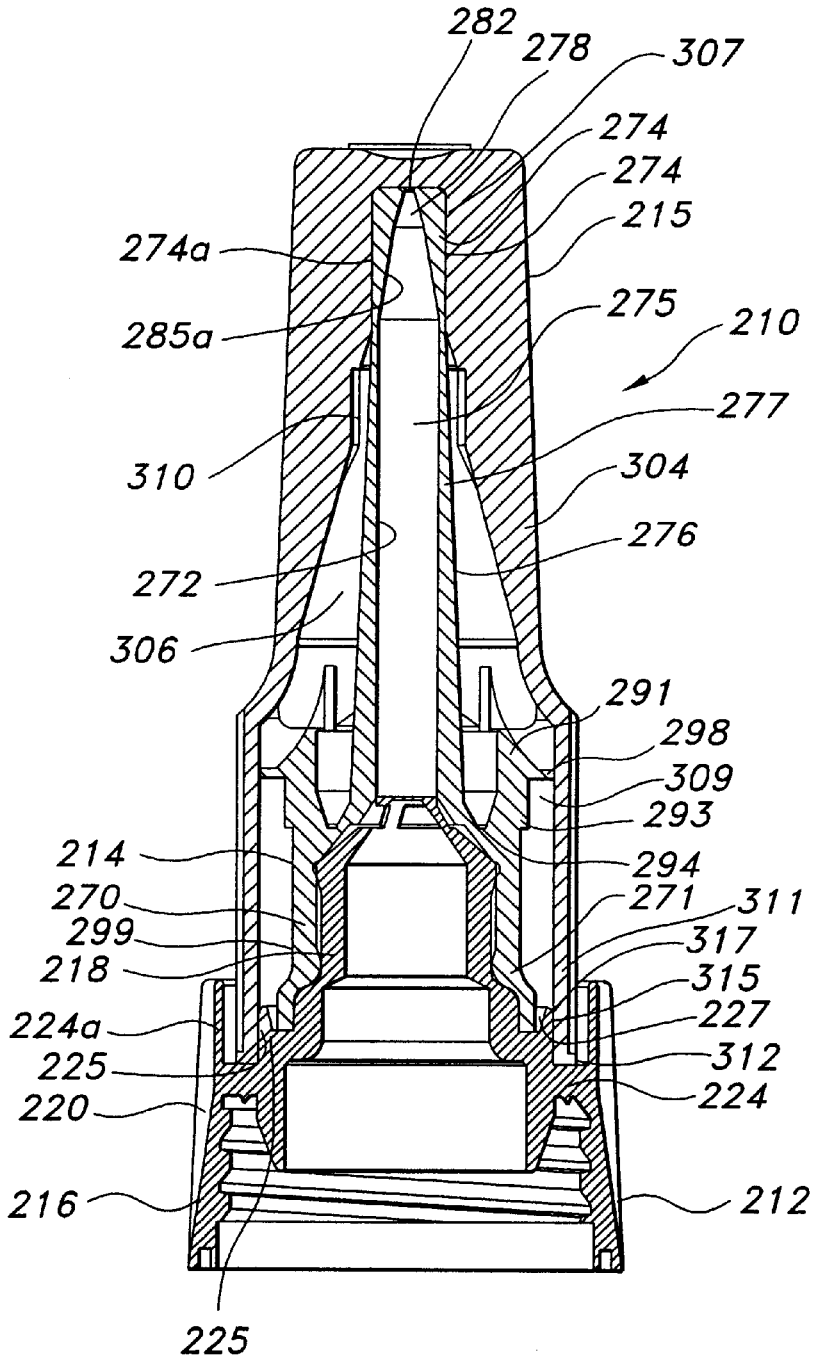
FIG. 7 is a cross-sectional view of the further embodiment of the dispensing closure assembly of the present invention.

A further preferred embodiment of the present invention is shown with respect to FIGS. 7–11. Referring to FIG. 7, the present embodiment of the invention provides a dispense closure assembly 210 for dispensing a fluid such as an anaerobic adhesive. The dispense closure assembly of FIGS. 7–11 is substantially similar to the dispense closure assembly 10 of FIGS. 1–6, and therefore similar reference numerals are used to denote similar components.

Figure 8:
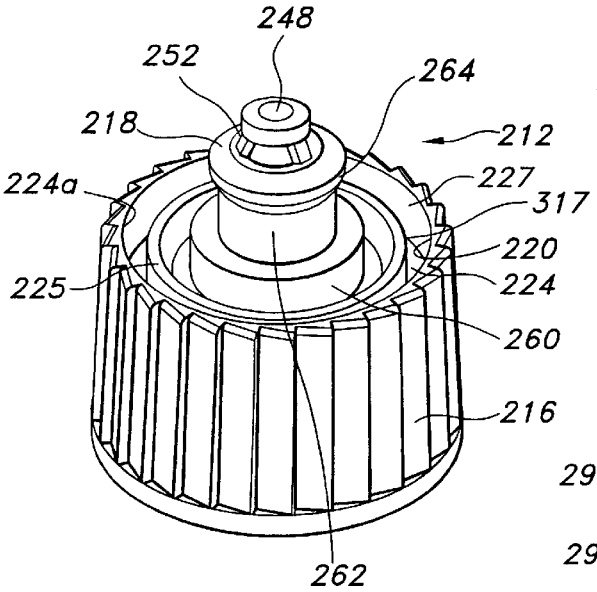
FIG. 8 is a top perspective view of the cap of the dispensing closure assembly of FIG. 7.
Figure 9:
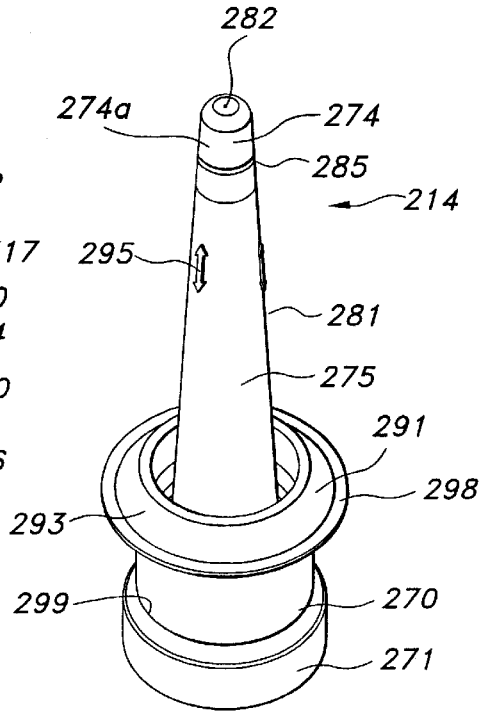
FIG. 9 is a top perspective view of the dispensing cover of the dispensing closure assembly of FIG. 7.
Figure 10:
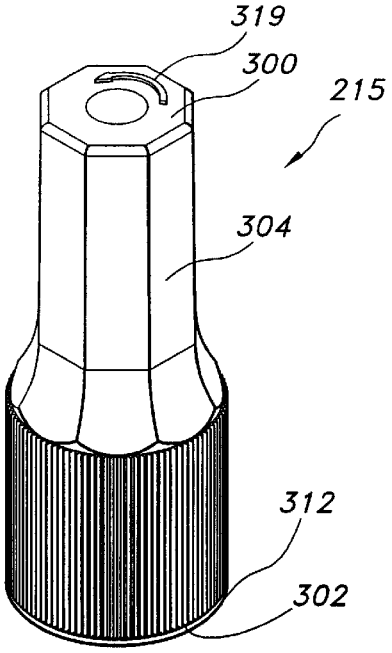
FIG. 10 is a top perspective view of the overcap of the dispensing closure assembly of FIG. 7.
Figure 11:
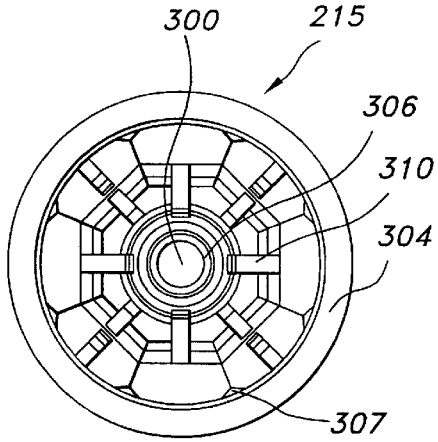
FIG. 11 is a bottom plan view of the overcap of FIG. 10.

Dispense closure assembly 210 includes a cap 212 shown in FIG. 8, a dispensing cover 214 shown in FIG. 9 and an overcap 215 shown in FIGS. 10 and 11. Each of the components of dispense closure assembly 210 may be formed of a suitable plastic by conventional manufacturing techniques. In a manner similar to that of the previously described embodiment, cover 214 is longitudinally movable with respect to cap 212 from a closed position blocking fluid flow to an open position allowing precise fluid metering through over cover 214. The present embodiment of dispensing closure assembly 210 employs a push/pull arrangement whereby the user manually grasps the dispensing cover 214 to move it longitudinally with respect to cap 212 as will be described in further detail hereinbelow.

As with the previous embodiment, dispense closure assembly 210 may dispense fluid having a viscosity in the range of from 10 cps to 8,000 cps requiring no more than lightly compressing the flexible portion of the portion of the container (not shown) to which it is attached. Dispenser closure assembly 210 provides for the user to select from two possible sizes for a dispense opening through which fluid is dispensed through dispensing cover 214 and also provides for the use of a luer slip cannula to provide additional dispense opening sizes. The selection of the proper dispense opening size is determined according to the viscosity of the fluid to be dispensed. The user need only make the selection prior to dispensing the contents of the container for the first time. The user then dedicates the dispense closure 210 to provide a dispense opening particularly suited for the fluid viscosity of the contents of the container. Once so dedicated, the user need only open and close the dispense closure assembly 210 prior to and after each use. As will be described in further detail hereinbelow, the proper dispense opening size is selected in manner similar to that described above with respect to previous embodiment.

Referring now to FIGS. 7 and 8, cap 212 includes a base portion 216 and an elongate dispense valve 218. Cap 212 is substantially similar to cap 12 described above with respect to FIGS. 2A and 2B. Base 216 is defined by an elongate cylindrical outer wall 220 and a transverse support wall 224. Valve 218 extends upwardly from transverse support wall 224. In the present illustrative embodiment, elongate cylindrical outer wall 220 extends upwardly from transverse support wall 224 so as to define an upward extent 224*a*. Cap 212 further includes an inner cylindrical wall 225 extending upwardly from transverse support wall 224 located radially inward from upward extent 224*a* of wall 224. Extent 224*a* and wall 225 define an open ended annular recess 227. Recess 227, which will described in further detail hereinbelow, accommodates dispensing closure 214 in the closed position.

In manner similar to that described above, dispense valve 218 includes a lower cylindrical portion 260, an upwardly extending cylindrical wall 262 and a radially extending annular stop bead 264 which progressively extend from transverse support wall 224. Dispense valve 218 further includes a distally located valve hub 248 including a dispense aperture 252 therethrough. A valve seat 250 defined about the dispense aperture 252.

As specifically shown in FIGS. 7 and 9, dispensing cover 214 is an elongate hollow member including valve engaging portion 270 at the lower end thereof and an elongate dispensing nozzle 275 extending upwardly therefrom. A dispensing tip 274 is formed at the upper end of nozzle 275. Dispensing cover 214 is mountable over the dispense valve 218 of cap 212 as shown FIG. 7, in a manner substantially similar to that shown with respect to the embodiment of FIGS. 1–6. Dispensing cover 214 is movable between an open position for the dispensing of fluid through dispensing tip 274 to a closed position as shown in FIG. 7 sealing dispense aperture 252 of valve hub 248.

In the closed position, as shown in FIG. 7, a lower cylindrical extent 271 of valve sealing portion 270 is accommodated within the annular recess 227 formed between upper extent 224*a* of cylindrical outer wall 220 and inner cylindrical wall 225. Such an arrangement helps maintain the dispensing cover 214 in a proper closed and seated position over dispense valve 218.

Nozzle 275 of cover 214 is an elongate generally conical member having dispensing tip 274 and dispensing opening 282 defined at the distal end thereof so as to permit dispensing of adhesive fluid therethrough. In the present illustrative embodiment, dispensing opening 282 has a diameter of approximately 0.0352 mm which has been found to allow drain back of adhesive therethrough after dispensing. This prevents the adhesive from remaining at the opening 282, which when cured could close the opening. Nozzle 275 is defined by a nozzle wall 277 having an inner surface 272 and an outer surface 276. As shown in FIG. 7, the inner surface 272 of wall 277 adjacent opening 282 includes a conical taper 278 to facilitate drain back of adhesive at the dispensing opening 282.

In a manner to similar to that shown in FIG. 6, the outer surface 274*a* of distal tip 274 is configured to accommodate a standard luer slip cannula assembly 110 in frictional engagement thereover. The outer surface 274*a* of tip 274 is specifically modified so as to appropriately match the configuration of a conventional luer slip cannula assembly so as to facilitate frictional retention thereover.

Also, in a manner similar to that described above, distal tip 274 includes a score notch 285 spaced from the distal end thereof at which location, the distal tip 274 may be severed so as to expose a larger dispense opening so as to permit dispensing of less viscous fluids. The inner surface 285*a* of nozzle 275 adjacent score notch 285, is also conically tapered to aid in drain back of adhesive after use.

Dispensing cover 214 of the present embodiment further includes a fluid containment well 291 formed intermediate valve engaging portion 270 and nozzle 275. Fluid containment well 291 is generally in the form of an open ended cup shaped member defined by a generally cylindrical side wall 293 and a bottom wall 294. The cylindrical side wall 293 and bottom wall 294 form a containment well with the lower end of nozzle 275.

After dispensing of adhesive fluid through dispensing tip 274, any adhesive residue which is not drawn back into dispensing cover 214 may track down the outer surface 276 of nozzle 275 which is contiguous with the dispensing opening. As dispensing cover 214 is designed to be manually grasped and actuated by the user, the user may come in contact with residual adhesive which has tracked down the outer surface 276 of cover 214. In order to prevent such contact, the present invention provides containment well 291 which collects any such residual adhesive which drains along the outer surface 276 of nozzle 275.

Further, a manual grasping region 299 is defined between containment well 291 and lower cylindrical member 271. This manual grasping region 299 is positioned below containment well 291 so that the adhesive which tracks down nozzle 275 is collected and contained above this region. Thus, the region at all times will be free from adhesive residue allowing the user to grasp the dispensing cover without risk of contacting residual adhesive. The manual grasping region 299 is constructed to be conveniently grasped with the users fingers.

As shown in FIG. 9, nozzle 275 may also include directional markings 295 in the form of double headed arrows. The directional markings 295 assist the user in determining the direction of movement of cover 214 with respect to cap 212.

Dispensing well 291 further includes a radially outwardly directed annular sealing web 298 extending from adjacent an upper end of side wall 293. Sealing web 298 is formed of a thin portion of the material forming dispensing cover 214 and due to its thinness is relatively deflectable. As will be described in further detail hereinbelow, sealing web 298 forms a seal with overcap 215 when it is placed thereover.

Referring now to FIGS. 7, 10 and 11, overcap 215 is shown in further detail. Overcap 215 is an elongate member having a closed upper end 300, an open lower end 302 and elongate generally cylindrical wall 304 extending therebetween. An interior cavity 306 is formed by wall 304 between closed end 300 and open end 302. Overcap 300 is designed to be positioned over cap 212 and dispensing cover 214 to enclose cover 214 in its closed position.

As shown in FIG. 7, adjacent the upper end 300 thereof, cylindrical wall 304 of overcap 214 defines an upper interior cylindrical wall surface 307 which is designed for sealing engagement along the outer surface 274*a* of dispensing tip 274. The sealed engagement between interior wall surface 307 of overcap 215 and the outer surface 274*a* of dispensing tip 274 provides a seal therebetween, thereby sealing dispense opening 282. Furthermore, engagement between the interior wall surface 307 of overcap 215 and the outer surface 274*a* of dispensing tip 274 is such that a seal is provided even where the dispensing tip 274 is severed at notch 285 to provide a larger dispense opening, as the engagement is below notch 285.

Wall 304 further includes a plurality of inwardly extending intermediate directional ribs 310 circumferentially spaced thereabout. Ribs 310 are provided so as to facilitate proper insertion of nozzle 275 into cavity 306. The ribs 310 engage the distal end of nozzle 275 as it is inserted so as to properly locate nozzle 275 within cavity 306.

The lower end of cavity 306 defined by wall 304 is constructed so as to engage sealing web 298 at an intermediate inner surface 309 thereof. This engagement provides a complete cylindrical seal therebetween. When the overcap 215 is positioned in closed position as shown in FIG. 7, a seal is provided between inner surface 309 of cylindrical wall 304 and cover 214 at sealing web 298. As sealing web 298 is formed of a thin deflectable web-like material, deflectable sealing engagement is achieved. Any adhesive contained within well 291 cannot track to the manual grasping region 299 of cover 214 even where the closed and covered dispensing closure assembly is inverted. The seal between the inner surface 309 of cylindrical wall 304 and the sealing web 298 prevents passage of adhesive.

In order to more securely frictionally retain overcap 215 on cap 212, overcap 215 includes an annular sealing flange 312 at the lower end thereof. Flange 312 extends radially outwardly from cylindrical wall 304 and is designed to engage in frictional relationship with the inner surface of upward extent 224 of cap 212. This frictional relationship provides a secure snap fit engagement between the overcap 215 and cap 212.

Additionally, in order to more securely retain overcap 215 on cap 212, an inside surface 311 of wall 304 adjacent the lower end includes a plurality of similarly spaced elongate arcuate ribs 315 thereabout. Ribs 315 are spaced inwardly from open end 302 and are equally spaced circumferentially thereabout. In the present illustrative embodiment, three ribs are provided in circumferentially spaced relation about the inside surface 311 of wall 304. Ribs 315 are designed for snap fit engagement with a cylindrical rim 317 extending about the upper end of inner wall 225. This snap fit engagement provides additional frictional securement of overcap 215 on cap 212. The snap fit engagement between dispensing cover 214 and overcap 215 may be overcome by a twisting motion of overcap 215 with respect to dispensing cover 214. In this regard, a directional arrow 319 is provided on upper end 302 to provide the user with assistance in removal.

While the present invention has been shown and described in detail above, it will be clear to the person skilled in the art that changes and modifications may be made without departing from the spirit and scope of the invention. That which is set forth in the foregoing description and accompanying drawings is offered by way of illustration only and not as a limitation. The true scope of this invention is measured of course by the claims.

What is claimed is:

1. A dispensing closure assembly for dispensing fluid from a fluid container comprising:

a cap attachable to the open end of said container, said cap having a sealable dispensing valve with a valve opening for passage of said fluid therethrough; and a dispensing cover movably supported over said cap, said dispensing cover being an elongate member having a dispensing tip at one end, valve engaging portion at the other end and a dispensing channel therebetween, said dispensing cover being movable between a closed position with said valve engaging portion in engagement with said valve for sealing said dispensing valve and an open position permitting fluid communication between said dispensing valve and said channel permitting dispensing of said fluid through said dispensing tip;

said cover further including an outer surface extending contiguous with said tip defining a fluid drainage surface, a manual grasping surface spaced from said dispensing tip, and a fluid containment well between said fluid drainage surface and said manual grasping surface for retaining fluid drainage along said drainage surface and preventing fluid contact along said manual grasping surface.

2. A dispensing closure assembly of claim 1 wherein said dispensing tip includes a first dispensing orifice defined at a distal end thereof.

3. A dispensing closure assembly of claim 2 wherein said dispensing tip is configured to accommodate a standard luer cannular slip over said distal end thereof.

4. A dispensing closure assembly of claim 2 wherein said dispensing tip includes a score notch adjacent said distal end for severing said distal end and defining a second dispensing orifice larger than said first dispensing opening.

5. A dispensing closure assembly of claim 4 wherein said first dispensing orifice has a diameter of approximately 0.0352 mm.

6. A dispensing closure assembly of claim 1 wherein said cap includes a generally cylindrical outer wall and an upper surface with said dispensing valve extending from said upper surface.

7. A dispensing closure assembly of claim 6 wherein said upper surface of said cap includes an inner wall extending from said upper surface, and wherein said outer wall extends above said upper surface, said inner and outer wall defining an annular recess for accommodating said valve engaging portion of said dispensing cover therein in said closed position.

8. A dispensing closure assembly of claim 7 further including:

an overcap positionable over said cap and dispensing cover.

9. A dispensing closure assembly of claim 8 wherein said overcap is an elongate member having a closed upper end, an open lower end and a cover cavity defined by a cavity wall for accommodating said dispensing cover therein.

10. A dispensing closure assembly of claim 9 wherein said cavity wall includes a sealing surface for sealing engagement with said outer surface of said cover at a location spaced from said dispensing tip.

11. A dispensing closure assembly of claim 1 wherein said fluid containment well is defined by an upwardly directed annular cup-shaped wall, said cup shaped wall extending about said outer surface of said dispensing cover.

12. A dispensing closure assembly of claim 11 wherein said cup-shaped wall includes an outwardly directed circumferential sealing web, said sealing web being engageable with said cavity wall for providing a seal thereat.

13. A dispensing closure assembly of claim 10 wherein said cavity wall includes inwardly extending direction ribs for engagement with said outer surface of said cover for directing said cover into said engagement with said dispensing tip.

14. A dispensing closure assembly of claim 10 wherein said overcap includes an outwardly directed circumferential flange for frictional engagement with said outer wall of said cap.

15. A dispensing closure assembly of claim 10 wherein said overcap includes a plurality of arcuate ribs extending inwardly from an inner surface of said cavity wall adjacent said open lower end, and wherein said cap includes an annular rim outwardly extending from said inner wall of said cap for snap engagement with said arcuate ribs.

* * * * *

UNITED STATES PATENT AND TRADEMARK OFFICE

CERTIFICATE OF CORRECTION

PATENT NO. : 6,619,517 B2
DATED : September 16, 2003
INVENTOR(S) : Vakiener et al.

It is certified that error appears in the above-identified patent and that said Letters Patent is hereby corrected as shown below:

Column 1,
Line 10, delete "...filed on September 18, 1998." and insert
-- ...filed on September 15, 1998. --

Column 6,
Line 14, delete "...working portion 170 and..." and insert
-- ...working portion 170 and... --.
Line 27, delete "...between and open and closed..." and insert
-- ...between an open and closed... --.

Signed and Sealed this

Twenty-fourth Day of February, 2004

JON W. DUDAS
*Acting Director of the United States Patent and Trademark Office*